United States Patent [19]

Evans et al.

[11] 4,198,919

[45] Apr. 22, 1980

[54] BUMPER PROTECTION DEVICE

[75] Inventors: Orde R. Evans; William D. Rhodes; Joseph O. Trahan, all of Lafayette, La.

[73] Assignee: Oreco III, Inc., Lafayette, La.

[21] Appl. No.: 911,910

[22] Filed: Jun. 2, 1978 (Under 37 CFR 1.47)

[51] Int. Cl.[2] ..... B63B 59/02

[52] U.S. Cl. ..... 114/219

[58] Field of Search ..... 114/219, 220; 267/139, 267/140, 141; 405/212, 215; 293/60, 62, 65

[56] References Cited

U.S. PATENT DOCUMENTS

| | | | |
|---|---|---|---|
| 1,815,413 | 7/1931 | Lockwood | 114/219 |
| 3,096,973 | 7/1963 | Bergen | 114/219 |
| 3,338,206 | 8/1967 | Motter | 114/219 |
| 3,381,484 | 5/1968 | Laughlin | 114/219 |
| 3,937,170 | 2/1976 | Drewett | 114/219 |

*Primary Examiner*—Trygve M. Blix
*Assistant Examiner*—Jesus D. Sotelo
*Attorney, Agent, or Firm*—Guy E. Matthews

[57] ABSTRACT

A device for and a method of inhibiting damage to a vessel and structure include a bumper mounted on a frame for absorbing the force or shock caused as the vessel moves or rams against the structure which receives the frame and bumper.

8 Claims, 3 Drawing Figures

BUMPER PROTECTION DEVICE

BACKGROUND AND BRIEF SUMMARY OF THE INVENTION

This invention relates generally to a device for and method of inhibiting damage to a vessel and structure in water as the vessel moves against the structure.

When boats or vessels are moved into position near a structure in water, the boat or structure may be severely damaged by the boat moving into or against the structure due to the thousands of foot pounds of force created by the weight of the boat and the wave action of water. To prevent such damage, some boat operators position tires or the like over the side of the boat or against the structure or dock to absorb the shock of the boat moving against the structure.

In accordance with this invention, a device for and method of inhibiting damage to a vessel and structure as the vessel moves against the structure in the water is disclosed and includes a frame mounted with the structure wherein a segment or portion of the frame extends above the surface of the water, a bumper means for mounting with the frame to absorb the force or shock caused by the boat moving against the structure and connecting means for mounting and connecting the bumper to the structure. A kit or assembly includes component parts capable of being assembled into the system set forth hereinabove.

BRIEF DESCRIPTION OF THE DRAWINGS

Other objects and advantages of the invention will become apparent upon reading the following detailed description and upon reference to the drawings, in which like reference characters are used throughout to designate like parts.

While the invention herein is illustrated in connection with the preferred method and apparatus, it is to be understood that this illustration is not intended to limit the invention to that embodiment and procedure and includes all alternative modifications and equivalents as may be included within the spirit and scope of the invention as defined by the appended claims.

DETAILED DESCRIPTION OF THE INVENTION

Figure 2:
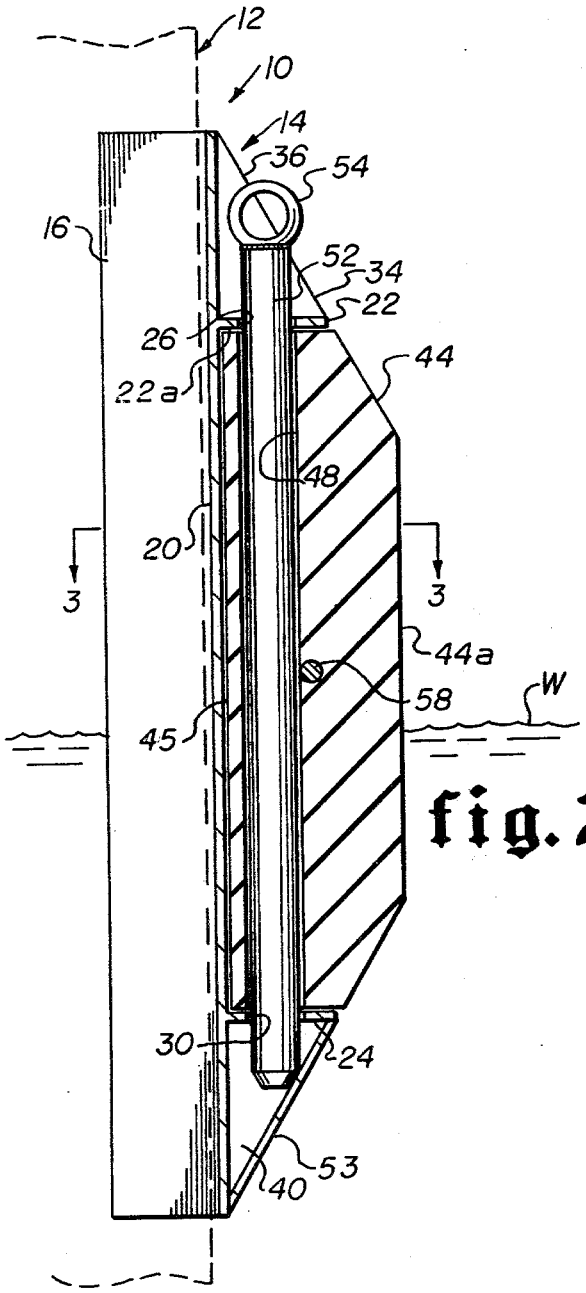
FIG. 2. is a sectional, elevational view of a preferred embodiment of the present invention shown in FIG. 1.
Figure 1:
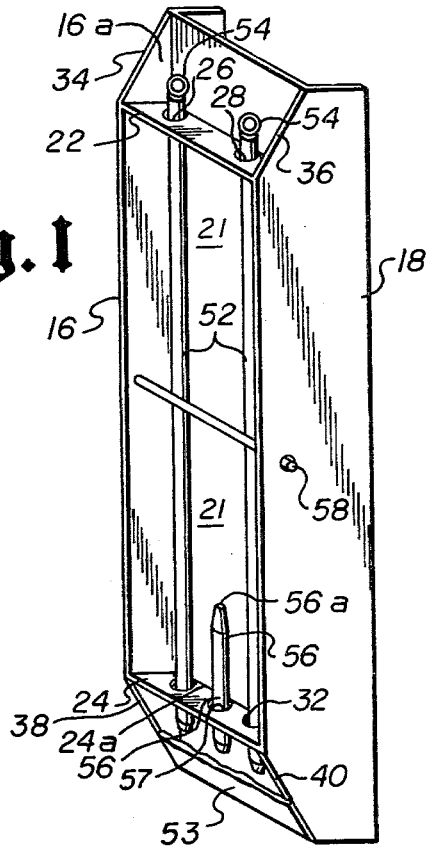
FIG. 1 is a perspective view of a preferred embodiment constructed according to the present invention.

As illustrated in FIGS. 1 and 2, the invention is generally designated at 10 and is mounted or connected to a structure 12 (FIG.2 and only partially disclosed) which is positioned in water W. The invention or device 10 is especially adapted to be mounted on cross braces, pilings, flow line risers, support legs and the like used in offshore platforms or docking facilities for protection of vessels or boats and the structures as the vessel or boat is docked or positioned against such structures.

Figure 3:
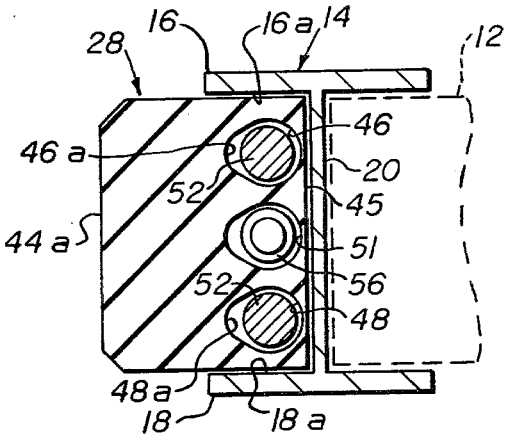
FIG. 3 is a plan view taken in the direction of the arrows 3—3 of the preferred embodiment of the present invention shown in FIG. 2.

The device 10 includes a frame 14 mounted with structure 12 with a portion or segment of the frame extending above the water W. Frame 14 includes side walls or members 16 and 18 and a cross member or wall 20 connected at each longitudinal end (not numbered) to the interior **16*a* and 18*a* of the walls 16 and 18, respectively, at approximately the middle portion of the transverse width of each of such members 16 and 18 (FIG. 3). Upper and lower cross members 22 and 24 are mounted at each end (not numbered) to side walls 16 and 18 and along one side 22*a* and 24*a*, respectively, to member 20 in the forward section or area 21 formed by the side members 16 and 18, connecting member 20 and the cross members 22 and 24. A plurality of holes or openings 26, 28 and 30, 32 is positioned in each cross member 22 and 24, respectively, with openings 26 and 30 and 28 and 32 in each respective cross member being aligned relative to each other. As illustrated, the upper and lower portions of side walls 16 and 18 may include shoulders 34, 36, 38, and 40 respectively, which taper at an angle from connecting member 20**.

A bumper means 44 is positioned in section 21 to absorb the force, shock, and movement caused by the vessel and wave action of the water W as the vessel moves toward and normally contacts or slams into the structure 12. Bumper means 44 includes longitudinal openings 46, 48, and 51 which extend along the longitudinal length of bumper means 44 adjacent the section 45 of bumper 44 which abuts connecting member 20. As further illustrated, openings 46 and 48 are oval shaped ((FIG. 3) such that the oval shape or side **46*a* and 48*a* extend toward the front surface 44*a* of the bumper means 44 for a purpose to be described hereinafter. It is to be understood that the number of longitudinal openings will depend on the size of frame 14 and bumper means 44**.

Connecting or pin means 52 longitudinally extend between the first and second members 22 and 24 through openings 46 and 48 of bumper means 44 for connecting and mounting the bumper means in space 21 as illustrated. The connecting means 52 also extends through holes 26, 30 and holes 28, 32 of members 22 and 24 for releasably connecting the bumper means 44 for enabling replacement of the bumper means 44 when damaged. Each pin 52 may include a shoulder at its lower end which is larger than holes 30 and 32 in plate 24 to prevent further movement longitudinally of the pins 52 or a stop lip 53 is provided in frame 14 to prevent this movement. The upper portion of each pin 52 preferably includes an eye means 54 mounted thereto through which a hook (not shown) may be inserted to withdraw the pins 52 from the plates 22, 24 and bumper means 44 as desired.

A stabbing or guide pin 56 having a stop lip 57 is positioned in opening 51 in plate 24 and extends upwardly parallel to pins 52. As further illustrated, pin 56 is provided with a tapered end **56*a* for facilitating entry of the pins 52 into oval opening 51 of bumper means 44. The pin 56 is positioned centrally relative to plate 24 and means 44 to enable the means 44 to be positioned onto space 21 for thereafter enabling insertion of pins 52 through openings 46 and 48**.

The length of frame member 14 is such that upper cross member 22 is above water surface W at high tide and lower cross member 24 is below water surface W at low tide. Cross support means 58 may be provided and extends through members 16 and 18 in front of pins 52 through the forward area of bumper means 44 to provide lift and support of the means 44.

It is to be understood that since the present invention can be assembled at the location where it is to be added to the structure 12, component parts may be provided in kit form for assembly into the invention 10 which will accomplish the end result as aforementioned.

In the operation of the invention, damage to a boat or vessel or structure 12 caused by the vessel moving against the structure 12 may be inhibited or prevented by providing bumper means 44 for absorbing the force, shock, and shear caused by movement of the boat toward the structure 12. The bumper means 44 is positioned such that the segment 45 extends into space 21. The guide pin 56 receives the means 44 and is centrally positioned to guide and extend upwardly into opening 51 such that the bumper means 44 is temporarily held in place. Pins 52 are then inserted through holes 26 and 28 in upper cross member 22, holes 46 and 48 in bumper means 44, and holes 30 and 32 in lower cross member 24 to mount the bumper means 44 in space 21. The stop shoulders 53 on each pin 52 prevent further movement of the pins 52 through plate 24.

If a boat or vessel moves or crashes against the means 44, the shock or impact is absorbed by the means 44 and the shock or impact is normally such that the segment 45 of means 44 is moved toward pins 52 and 56 such that the pins fill the oval shaped part of the openings to enable and partially help in absorbing the shock, force, and shear of the vessel impacting with means 44. Damaged bumper means 44 may be replaced by withdrawing pins 52 from the holes in cross members 22 and 24 bumper 44, thereafter positioning a different bumper means as set forth hereinabove.

From the foregoing it will be seen that this invention is one well adapted to attain all of the ends and objects hereinabove set forth, together with other advantages which are obvious and which are inherent to the apparatus.

It will be understood that certain features and subcombinations are of utility and may be employed with reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

The invention having been described, what is claimed is:

1. A bumper protection system for inhibiting damage to a vessel and structure in the water when the vessel moves against the structure, comprising:

(a) a frame mounted with the structure with a segment extending above the surface of the water, said frame including:
  (i) means for mounting with the structure; and
  (ii) upper and lower cross members having openings therein mounted with said means for mounting;

(b) a bumper for absorbing shock, force, and shear caused by the vessel moving against said bumper structure, said bumper having a connecting segment having openings therein for positioning between said upper and lower cross members of said frame;

(c) connecting means removably positioned between said first and second cross members and extending through said openings in said cross members and extending through said openings in said bumper for mounting said bumper to said frame; and (d) guide means centrally positioned on said lower cross member and said connecting segment of said bumper including an opening centrally positioned therein for receiving said guide means to enable positioning of said bumper relative to said lower cross member.

2. The device as set forth in claim 1 wherein each of said connecting means includes an eye lift mounted on an upper end for enabling, lifting, and removal of each of said means from said cross members and bumper means to enable said bumper means to be readily replaced.

3. The device as set forth in claim 1 including support means mounted adjacent said connecting means, said support means extending through said bumper for supporting said bumper.

4. A kit having component parts capable of being assembled into a device for inhibiting damage to a boat moving against a structure in water, the kit comprising the combination of:

(a) a frame adapted to be mounted with the structure so that a portion extends substantially vertically above the surface of the water, said frame having:
  (i) side walls;
  (ii) a wall connecting the side walls to one another; and
  (iii) first and second cross members extending between the side walls;

(b) a bumper for absorbing a force caused by movement of the boat toward the structure, said bumper having a connecting portion adapted to be positioned within the space formed by the side walls, connecting wall, and first and second members of said frame;

(c) a guide pin centrally positioned on said second cross member for locating within an opening centrally positioned within said bumper to enable positioning of said bumper relative to said second member; and (d) pins adapted to be mounted between the first and second members of said frame, and to extend the connecting portion of said bumper cushioning the impact of the boat against the structure which inhibits damage to the boat when the bumper is mounted on the frame and the frame mounted with the structure.

5. A method of inhibiting damage to a boat moving against a structure in water, comprising the steps of:

(a) providing a bumper for absorbing a force caused by movement of the boat toward the structure;

(b) positioning a connecting portion of the bumper upon a guide pin positioned within a space formed in a frame;

(c) connecting the bumper to the frame by inserting pins through holes in first and second cross members provided on the frame and holes in the connecting portion of said bumper; and (d) mounting said frame to the structure with a portion extending vertically from the surface of the water, the bumper cushioning the impact of the boat against the structure which inhibits damage to the boat.

6. The method as set forth in claim 5, including the steps of:

(a) withdrawing the pins from the frame to disconnect the bumper when it becomes damaged;

(b) removing the damaged bumper from the frame;

(c) positioning a connecting portion of a different bumper upon the guide pin positioned within the space formed in the frame; and (d) inserting pins through the holes in the first and second cross members and holes in the connecting portion of the different bumper to connect the different bumper to the mount frame which replaces the damaged bumper.

7. A bumper protection system for inhibiting damage to a vessel and structure in the water when the vessel moves against the structure, comprising:

(a) a frame mounted with the structure with a segment extending above the surface of the water, said frame including:

(i) means for mounting with the structure; and (ii) upper and lower cross members having openings therein mounted with said means for mounting;

(b) bumper means for absorbing shock, force and shear caused by the vessel moving against said bumper means structure, said bumper means having its longitudinal axis in vertical orientation for providing improved support characteristics to said bumper means, and having a connecting segment having openings therein in vertical orientation for positioning between said upper and lower cross members of said frame; guide means centrally positoned on said lower cross member and said connecting segment of said bumper means including an opening centrally positioned therein for receiving said guide means to enable positioning of said bumper means relative to said lower cross member; and (c) connecting means removably positioned between said first and second cross members and extending through said openings in said cross members and extending through said vertical openings in said bumper means for mounting said bumper means to said frame.

8. The device as set forth in claim 7, wherein the longitudinal axes of said frame and said guide means are in vertical orientation for providing improved support characteristics to said bumper means and said bumper system.

* * * * *